US006296371B1

(12) United States Patent
Shiau

(10) Patent No.: US 6,296,371 B1
(45) Date of Patent: Oct. 2, 2001

(54) FLASHLIGHT WITH TAIL CAP SWITCH ASSEMBLY

(76) Inventor: Wen-Chin Shiau, No. 10, Alley Lane 551, Sec. 1, Wan Shou Rd., Kuei-Shan Hsiang, Tao-Yuan Hsien (TW)

( * ) Notice: Subject to any disclaimer, the term of this patent is extended or adjusted under 35 U.S.C. 154(b) by 0 days.

(21) Appl. No.: 09/633,376

(22) Filed: Aug. 7, 2000

(30) Foreign Application Priority Data

Feb. 1, 2000 (TW) ..... 089201838

(51) Int. Cl.[7] ..... F21L 4/04
(52) U.S. Cl. ..... 362/206; 362/116; 200/60
(58) Field of Search ..... 362/116, 205, 362/206; 200/60

(56) References Cited

U.S. PATENT DOCUMENTS 4,939,628 * 7/1990 Wang ..... 362/206
5,008,784 * 4/1991 Wang ..... 362/206

* cited by examiner

*Primary Examiner*—Stephen Husar
(74) *Attorney, Agent, or Firm*—Merchant & Gould P.C.

(57) ABSTRACT

A flashlight includes a conductive barrel, a tubular tail cap member, and a tail cap switch assembly. The barrel has a threaded rear end portion with a contact end face. The tail cap member is sleeved threadedly on the rear end portion, and has an open rear portion formed with a radial inward annular flange that is spaced apart from the contact end face. The switch assembly includes a push button cap made from an insulator material and having a contact support portion disposed in the tail cap member between the annular flange and the contact end face. A cap engaging portion extends rearwardly from the contact support portion and through the annular flange, and is in sliding engagement with the annular flange. A conductive contact member is disposed on the contact support portion. An operating portion is formed on a rear end of the cap engaging portion, and is operable from the open rear portion so as to move the push button cap to move the contact member to contact the contact end face.

8 Claims, 3 Drawing Sheets

FLASHLIGHT WITH TAIL CAP SWITCH ASSEMBLY

BACKGROUND OF THE INVENTION

1. Field of the Invention

The present invention relates to a flashlight, more particularly to a flashlight with a tail cap switch assembly that is simple in construction, and that can be mass-produced at a reduced cost.

2. Description of the Related Art

A conventional flashlight mainly includes a head cap, a barrel having a front end coupled threadedly with the head cap, a bulb holder disposed inside the barrel, and a tail cap coupled threadedly with a rear end of the barrel. The barrel is rotatable relative to the head cap so as to control on/off operations of the flashlight. The tail cap is also rotatable to control the on/off operations of the flashlight due to arrangement of a tail cap switch assembly disposed in the tail cap. A conventional tail cap switch assembly has one end connected electrically to a spring that abuts against a battery unit disposed in the barrel, and an opposite end projecting from an open rear portion of the tail cap to form an operating portion. When the tail cap is rotated to translate forwardly relative to the barrel, electrical connection is established between the barrel and the battery unit, which will be broken by rotating the tail cap to result in rearward translation. In addition, when the operating portion is pressed, temporary electrical connection is established, and is interrupted upon release of the pressure applied on the operating portion. With reference to FIGS. 1 and 2, a conventional tail cap switch assembly 1 is shown to include a push button cap 11 that is formed from metal, and that has a conductive annular flange 12 at an intermediate section thereof such that, when the push button cap 11 is disposed in a tail cap member 2, the annular flange 12 is retained by a radial inward flange 21 of the tail cap member 2, and is prevented from slipping through an open rear portion of the tail cap member 2. The outer surface of the push button cap 11 is coated with an insulation material 13 to prevent electrical contact between the push button cap 11 and the surrounding wall of a barrel 3. A coil spring 8 has one end disposed on the push button cap 11, and an opposite end abutting against a battery unit 5 disposed in the barrel 3 for establishing electrical connection between the battery unit 5 and the push button cap 11. The push button cap 11 further has an operating portion projecting through the open rear portion of the tail cap member 2.

However, the above-described construction is deficient in the following aspects:

1. Since the push button cap 11 is a solid block of metal, it requires laborious machining. Hence, mass production thereof is difficult.

2. As the push button cap 11 has to be coated with an insulation material 13 in order to prevent electrical contact with the surrounding wall of the barrel 3, the manufacturing process is complicated and costly.

3. Since the entire push button cap 11 is utilized as an electrical conductive element, material costs are relatively high.

SUMMARY OF THE INVENTION

Therefore, the main object of the present invention is to provide a flashlight with a tail cap switch assembly that is simple in construction, and that can be mass-produced at a reduced cost.

Accordingly, a flashlight of the present invention includes a conductive barrel, a tubular tail cap member, and a tail cap switch assembly. The conductive barrel is adapted to receive a battery unit therein, and has an externally threaded rear end portion with a contact end face. The tubular tail cap member is sleeved on the rear end portion of the barrel, and is formed with an internal screw thread for coupling threadedly therewith. The tail cap member has an open rear portion formed with a radial inward annular flange that is spaced apart from the contact end face in an axial direction relative to the tail cap member. The tail cap switch assembly includes a push button cap and a conductive contact member. The push button cap is made from an insulator material, and has a contact support portion disposed in the tail cap member between the annular flange and the contact end face. A cap engaging portion extends rearwardly from the contact support portion and in the axial direction through the annular flange, and is in sliding engagement with the annular flange. An operating portion is formed on a rear end of the cap engaging portion, and is accessible from the open rear portion of the tail cap member. The conductive contact member is disposed on the contact support portion, and is adapted to connect electrically with the battery unit. The operating portion is operable so as to move the push button cap in the axial direction to move the contact member to contact the contact end face so that electrical connection can be established between the barrel and the battery unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
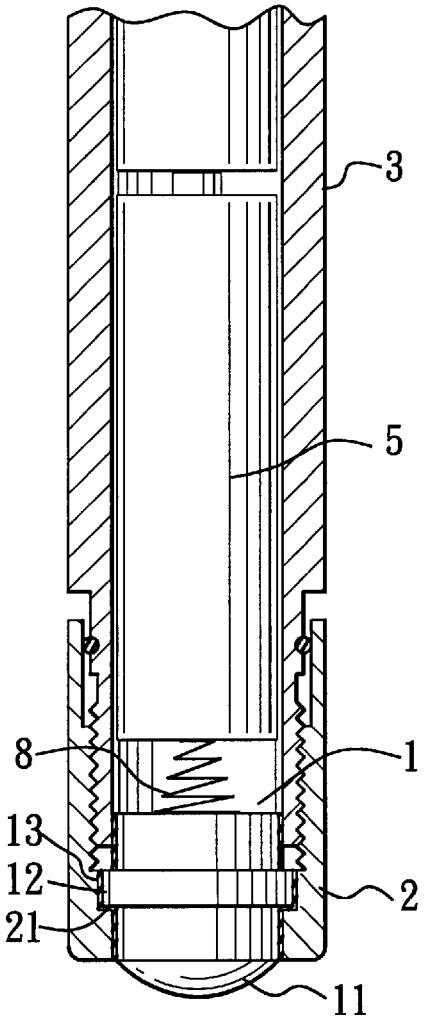
FIG. 1 PRIOR ART
FIG. 1 is a fragmentary sectional view of a flashlight with a conventional tail cap switch assembly.
Figure 2:
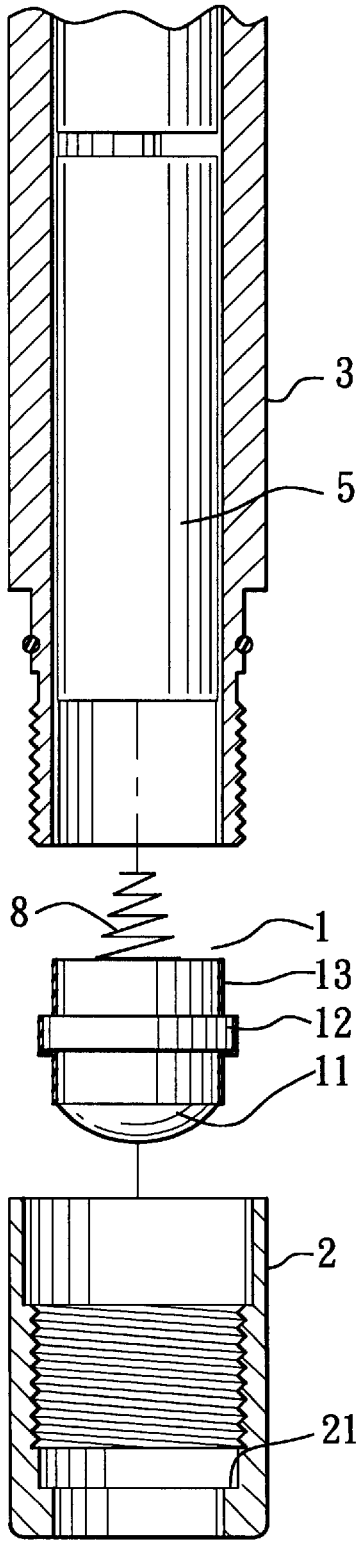
FIG. 2 PRIOR ART
FIG. 2 is a fragmentary exploded sectional view of the flashlight with the conventional tail cap switch assembly.
Figure 3:
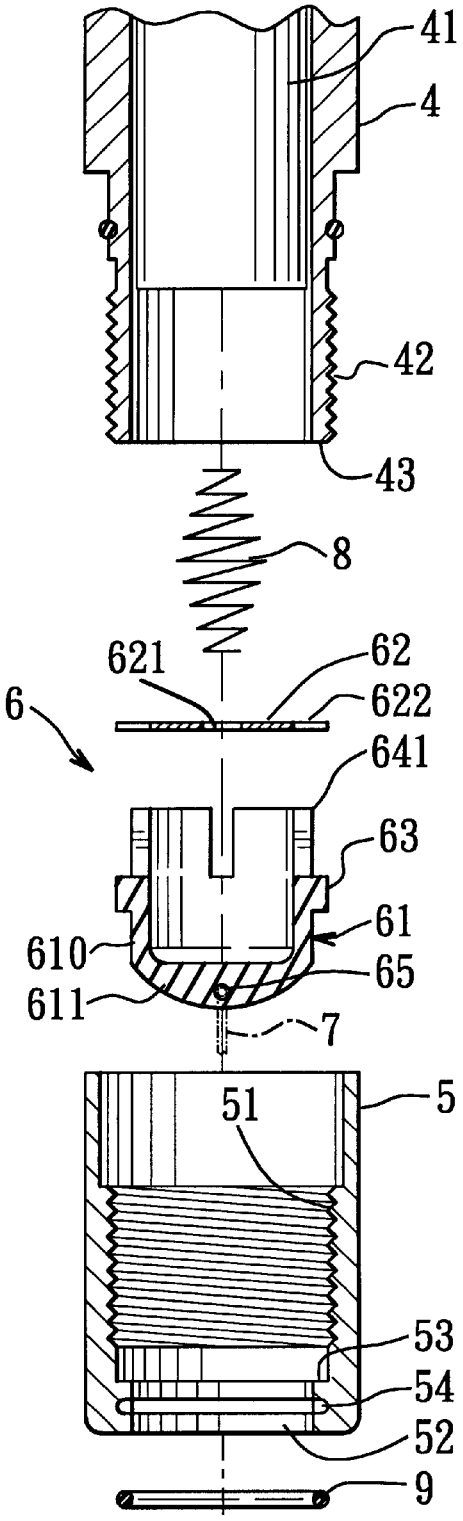
FIG. 3 is a fragmentary exploded sectional view of the preferred embodiment of a flashlight with a tail cap switch assembly according to the present invention.
Figure 4:
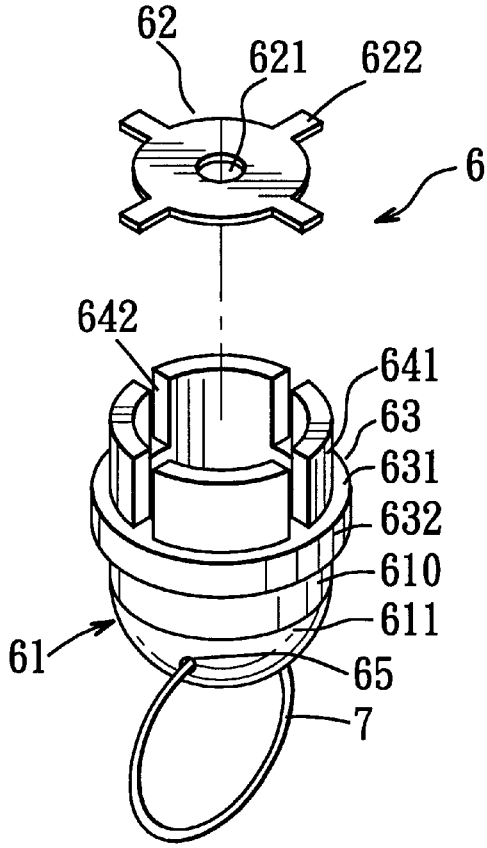
FIG. 4 is an exploded perspective view of the tail cap switch assembly of the preferred embodiment.

With reference to FIGS. 3 and 4, the preferred embodiment of a flashlight according to the present invention is shown to include a conductive barrel 4, a tubular tail cap member 5, and a tail cap switch assembly 6. The barrel 4 is adapted to receive a battery unit 41 therein, and has an externally threaded rear end portion 42 with a contact end face 43.

The tubular tail cap member 5 is sleeved on the rear end portion 42 of the barrel 4, and is formed with an internal screw thread 51 for coupling threadedly therewith. The tail cap member 5 has an open rear portion 52 formed with a radial inward annular flange 53 that is spaced apart from the contact end face 43 in an axial direction relative to the tail cap member 5.

The tail cap switch assembly 6 includes a push button cap 61 and a conductive contact member 62. The push button cap 61 is made from an insulator material, such as plastic, and has a contact support portion 63 disposed in the tail cap member 5 between the annular flange 53 and the contact end face 43. The contact support portion 63 is annular, and has an upper surface 631 and a circumferential rim 632. The contact support portion 63 is formed with a plurality of barriers 641 extending forwardly from the upper surface 631 and spaced apart from each other. Every adjacent pair of the barriers 641 form a gap 642 therebetween. A cap engaging portion 610 extends rearwardly from the contact support portion 63 and in the axial direction through the annular flange 53, and is in sliding engagement with the annular flange 53. An operating portion 611 is formed on a rear end of the cap engaging portion 610, and extends rearwardly through the open rear portion 52 of the tail cap member 5 such that it is accessible from the open rear portion 52.

Figure 5:
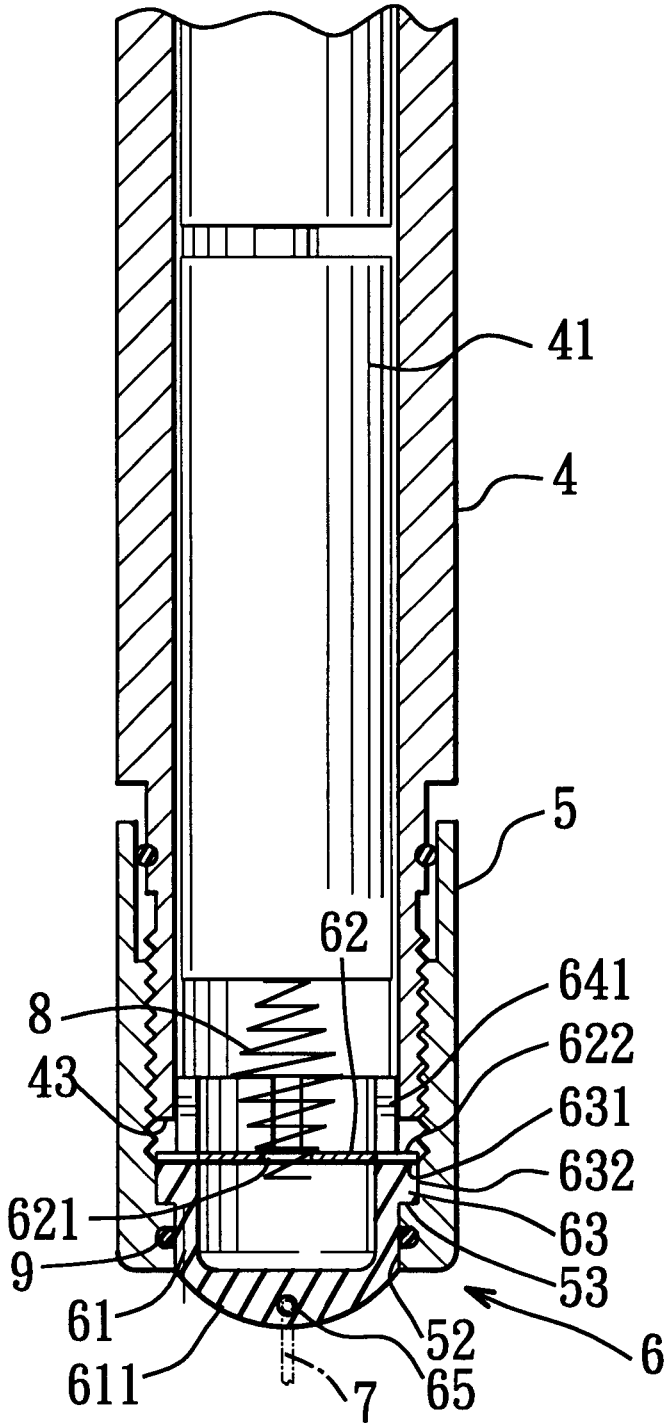
FIG. 5 is a fragmentary sectional view of the preferred embodiment in an assembled state.

The contact member 62 is disposed on the contact support portion 63, and is adapted to connect electrically with the battery unit 41. The contact member 62 is formed as a plate that is confined by the barriers 641, and has a plurality of radial rim parts 622 that extend respectively through the gaps 642 among the barriers 641 to the circumferential rim 632 of the contact support portion 63. With further reference to FIG. 5, the operating portion 611 is operable so as to move the push button cap 61 in the axial direction to move the contact member 62 to contact the contact end face 43 so that electrical connection can be established between the barrel 4 and the battery unit 41.

The switch assembly 6 further includes a conductive coil spring 8 that has one end adapted to abut against the battery unit 41, and an opposite end mounted on and abutting against the contact member 62 so that the contact member 62 can be connected electrically with the battery unit 41. The contact member 62 is preferably formed with securing means, such as a mounting hole 621 in this embodiment, for mounting the opposite end of the coil spring 8 thereon.

The flashlight of the present invention may further include a key ring 7 that is mounted in a through hole 65 in the operating portion 611 of the push button cap 6 to facilitate carrying or suspension of the flashlight. In addition, the annular flange 53 may be formed with an annular groove 54 for mounting a seal ring 9 that is in watertight contact with the cap engaging portion 610.

During assembly, the switch assembly 6 is disposed in the tail cap member 5, and the tail cap member 5 is coupled threadedly with the rear end portion 42 of the barrel 4 such that the coil spring 8 disposed on the contact member 62 has one end abutting against the battery unit 41 in the barrel 4, and such that the operating portion 611 of the push button cap 61 projects through the open rear portion 52 of the tail cap member 5. As the contact support portion 63 is seated on the annular flange 53, the push button cap 61 is prevented from slipping out of the open rear portion 52. At this point, the rim parts 622 of the contact member 62 are not in contact with the contact end face 43. In use, when the tail cap member 5 is rotated to result in forward translation relative to the barrel 4, the push button cap 61 is brought to move forwardly therewith so that the rim parts 622 contact the contact end face 43 to establish electrical connection between the barrel 4 and the battery unit 41. Thereafter, if the tail cap member 5 is rotated to result in rearward translation relative to the barrel 4, the push button cap 61 is moved rearwardly away from the contact end face 43, thereby breaking the electrical connection. At this time, a pressure exerted on the operating portion 611 projecting through the open rear portion 52 will push the contact member 62 forwardly so that the rim parts 622 contact the contact end face 43 to establish temporary electrical connection between the barrel 4 and the battery unit 41. The electrical connection will be interrupted upon release of the pressure applied on the operating portion 611.

In view of the aforesaid, the flashlight of the present invention has the following advantages:

1. The push button cap 61 has a simple construction, and can be mass-produced by injection molding in a quick manner.

2. As there is no need to apply an insulation coating to the push button cap 61, labor and materials can be saved.

3. Since most of the components of the flashlight of the present invention can be made from plastic materials, material costs can be reduced considerably.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A flashlight comprising:

a conductive barrel adapted to receive a battery unit therein and having an externally threaded rear end portion with a contact end face;

a tubular tail cap member sleeved on said rear end portion of said barrel and formed with an internal screw thread for coupling threadedly therewith, said tail cap member having an open rear portion formed with a radial inward annular flange that is spaced apart from said contact end face in an axial direction relative to said tail cap member; and a tail cap switch assembly including a push button cap made from an insulator material and having a contact support portion disposed in said tail cap member between said annular flange and said contact end face, a cap engaging portion extending rearwardly from said contact support portion and in the axial direction through said annular flange and in sliding engagement with said annular flange, and an operating portion formed on a rear end of said cap engaging portion and accessible from said open rear portion of said tail cap member, and a conductive contact member disposed on said contact support portion and adapted to connect electrically with the battery unit, said operating portion being operable so as to move said push button cap in the axial direction to move said contact member to contact said contact end face so that electrical connection can be established between said barrel and the battery unit.

2. The flashlight of claim 1, wherein said switch assembly further includes a conductive coil spring having one end adapted to abut against the battery unit and an opposite end mounted on said contact member so that said contact member can be connected electrically with the battery unit.

3. The flashlight of claim 1, wherein:

said contact support portion is annular and is formed with a plurality of forwardly extending barriers that are angularly spaced apart from each other, every adjacent pair of said barriers forming a gap therebetween; and said contact member is formed as a plate that is confined by said barriers, and has a plurality of radial rim parts that extend respectively through said gaps among said barriers.

4. The flashlight of claim 3, wherein said switch assembly further includes a conductive coil spring having one end adapted to abut against the battery unit and an opposite end that abuts against said contact member so that said contact member can be connected electrically with the battery unit.

5. The flashlight of claim 4, wherein said contact member is formed with a mounting hole for mounting said opposite end of said coil spring thereon.

6. The flashlight of claim 1, wherein said operating portion of said push button cap extends rearwardly through said open rear portion of said tail cap member.

7. The flashlight of claim 6, further comprising a key ring mounted on said operating portion of said push button cap.

8. The flashlight of claim 1, further comprising a seal ring mounted on said annular flange and in watertight contact with said cap engaging portion.

* * * * *